US006913659B2

(12) United States Patent
Oogushi et al.

(10) Patent No.: US 6,913,659 B2
(45) Date of Patent: Jul. 5, 2005

(54) RAPID COOLING DEVICE FOR STEEL BAND IN CONTINUOUS ANNEALING EQUIPMENT

(75) Inventors: Keiji Oogushi, Kitakyushu (JP); Hisamoto Wakabayashi, Kitakyushu (JP)

(73) Assignee: Nippon Steel Corporation, Tokyo (JP)

( * ) Notice: Subject to any disclaimer, the term of this patent is extended or adjusted under 35 U.S.C. 154(b) by 10 days.

(21) Appl. No.: 10/467,217

(22) PCT Filed: Apr. 2, 2002

(86) PCT No.: PCT/JP02/03311

§ 371 (c)(1),
(2), (4) Date: Aug. 6, 2003

(87) PCT Pub. No.: WO02/081760

PCT Pub. Date: Oct. 17, 2002

(65) Prior Publication Data

US 2004/0061265 A1 Apr. 1, 2004

(30) Foreign Application Priority Data

Apr. 2, 2001 (JP) ..... 2001-103735

(51) Int. Cl.[7] ..... C21B 7/10
(52) U.S. Cl. ..... 148/661; 266/46
(58) Field of Search ..... 266/46, 103, 111; 148/661

(56) References Cited

U.S. PATENT DOCUMENTS 4,625,431 A * 12/1986 Nanba et al. ..... 266/111

FOREIGN PATENT DOCUMENTS

| | | |
|---|---|---|
| JP | 62-116724 | 5/1987 |
| JP | 9-194954 | 7/1997 |

* cited by examiner

*Primary Examiner*—Scott Kastler
(74) *Attorney, Agent, or Firm*—Kenyon & Kenyon

(57) ABSTRACT

The present invention provides a cooling apparatus having sufficient cooling ability in the cooling process of a continuous annealing facility and capable of minimizing the strip temperature difference in the width direction caused by the high speed blowing of the gas and preventing the strip from fluttering by making the most of the holding rolls, wherein the continuous annealing facility a plurality of nozzles for blowing gas protruding from a surface of a cooling chamber installed in the continuous annealing facility so as to keep the tips of the nozzles 50 to 100 mm distant from the surface of the steel strip and the cooling chamber is disposed so that the maximum width of the steel strip (Wmax:mm) and the distance (H:mm) from the surface of the cooling chamber to the steel strip satisfy the expression (1) below:

$$6<W\max/H<13 \quad (1)$$

1 Claim, 9 Drawing Sheets

RAPID COOLING DEVICE FOR STEEL BAND IN CONTINUOUS ANNEALING EQUIPMENT

TECHNICAL FIELD

This invention relates to an apparatus for rapidly cooling a steel strip by blowing gas through nozzles of a higher cooling capacity than conventional ones in a continuous annealing facility (furnace) to apply heat treatment to the steel strip continuously.

BACKGROUND ART

A continuous annealing furnace, as is well known, is able to heat, soak and cool a steel strip continuously, and when required, to subsequently apply overaging treatment to it. In these processes, besides the temperature of the heating (annealing temperature) and the time of the soaking, cooling a steel strip is important to obtain a steel strip having the desired properties. For instance, in order to enhance the aging property, fluting resistance and other properties of a steel strip, increasing the rate of the cooling and then applying the overaging treatment is believed to be effective. A variety of cooling medium are currently used for cooling a steel strip after the heating and soaking, and the rate of cooling a steel strip is different depending on the choice of the cooling medium.

A very high cooling rate can be obtained when water is used as the cooling medium; a cooling rate in the range of ultra rapid cooling can be attained. The most serious drawback of the water cooling is, however, that a strip deformation called cooling buckle occurs as a result of quenching strain. Another problem is that an oxide film forms on the surface of a strip owing to the contact with water, and an additional facility to remove the oxide film is necessary. For these reasons, a water cooling apparatus is economically disadvantageous.

As a means to solve the above problem, a roll cooling method, wherein a steel strip is cooled by making it contact the surface of a roll cooled by water or some other cooling medium circulating through it, is employed. This method, however, has the following problem.

All the steel strips passing through a continuous annealing furnace are not necessarily flat and, therefore, there are cases that the strip contacts the cooling roll only partially across the width. The local lack of contact causes uneven cooling of the strip in the transverse direction, resulting in the deformation of the steel strip. This necessitates a means to make the strip flat before contacting the cooling roll, which increases equipment costs.

As another cooling means, a cooling method using a gas as a cooling medium has been commercially applied, and there are various records of this method. While the cooling rate by this method is lower than the water cooling or the roll cooling mentioned above, it enables comparatively uniform cooling in the transverse direction. For the purpose of raising the cooling rate, which constitutes the most serious shortcoming of the gas cooling method, a technique to raise the cooling rate by disposing the tips of the nozzles for blowing the cooling medium gas as close to the steel strip as possible and thus raising the rate of heat conduction and another to use hydrogen gas as the blown gas have been disclosed.

Japanese Examined Patent Publication No. H2-16375 is an example of the technique to raise the heat conductivity by disposing the tips of the gas blowing nozzles close to the steel strip. This is a technology to realize efficient cooling by decreasing the distance from the nozzle tips to the steel strip. In the proposed technology, specifically, the length of the nozzles protruding from a surface of a cooling gas chamber (cooling box) is set at 100 mm−Z or more (where Z is the distance from the nozzle tips to the surface of the steel strip) and, by this, a chamber is provided for the gas blown through the protruding nozzles to flow backward after hitting the steel strip. Said publication discloses that this arrangement decreases the stagnation of the blown gas at the steel strip surface and enhances the cooling uniformity in the strip width direction.

Further, they carried out an experiment to find the optimum point of heat transfer coefficient by changing the protrusion height of the nozzles from 50 mm−Z to 200 mm−Z, and, based on the experiment, proposed a cooling apparatus having the most efficient cooling capacity at that time as a cooling apparatus used in the cooling zone of a continues annealing furnace. As a result of the development of the cooling apparatus, it was made possible to raise the heat transfer coefficient, which had usually been 100 Kcal/$m^2$·hr·° C., to 400 Kcal/$m^2$·hr·° C.

A further enhancement of the cooling rate was required thereafter, but there was a limit in the enhancement of the cooling rate as far as conventional apparatuses were concerned, wherein an atmosphere gas of 95% or so of $N_2$ mixed with 5% or so of $H_2$ was circulated, in most cases, as a cooling medium.

The use of hydrogen gas as the cooling medium was proposed for the purpose of solving the problem. It had long been known that cooling capacity could be improved by using hydrogen gas, but this had not been commercially applied before owing to the dangerous nature of hydrogen gas.

Japanese Unexamined Patent Publication No. H9-235626 discloses a technology to realize rapid cooling by raising the concentration of hydrogen gas. This is a technology to raise the cooling rate by controlling the hydrogen concentration in a cooling gas to 30 to 60% and its temperature to 30 to 150° C. and blowing the gas onto a steel strip at a blowing speed of 100 to 150 m/sec. in a rapid cooling zone. Further, to achieve a desired cooling rate, the distance from the steel strip surface to the tips of the protruding nozzles, each having a round blowing hole, is set at 70 mm or less.

A technology for using hydrogen gas as the cooling medium has thus been proposed concretely, and its commercial application is imminent.

SUMMARY OF THE INVENTION

In the technique to cool a steel strip by increasing the concentration of hydrogen in the atmosphere gas mainly consisting of $N_2$ and blowing the gas through the nozzles at a blowing speed of 100 to 150 m/sec., generally speaking, it is necessary to secure a blowing speed of 100 to 150 m/sec. and, as a consequence, the amount of gas blown to the steel strip is be large. While the cooling capacity is increased by blowing the large amount of gas, there arises a new problem in relation to the distribution of the temperature of the strip in the width direction as a result of the gas flow after hitting the steel strip. This problem relates to the fact that the gas, after hitting the steel strip and bouncing back, forms a certain gas layer along the strip surface and flows out through openings located at the sides of the strip in the width direction.

During the process, the gas layer formed after the gas is blown to the strip causes the strip temperature difference in the width direction. However, in the technology disclosed in said publication, it is so considered that the blown gas can flow out of the space behind the protruding nozzles by setting the protruding height of the nozzles at 50 mm−Z to 200 mm−Z.

However, as it is necessary to blow a large amount of gas for cooling the steel strip, the range of the protrusion height of the nozzles specified above is, though effective to some extent, not sufficient for solving the problem of the temperature difference in the strip width direction. Further, the steel strip flutters due to the high speed blowing of the gas and pairs of holding rolls must be installed between the cooling apparatuses to suppress the flutter. However, a good effect is not expected from the rolls, because the places where the rolls can be installed are limited.

In view of the above reasons, the object of the present invention is to provide a cooling apparatus having sufficient cooling ability in the cooling process of a continuous annealing facility and capable of minimizing the strip temperature difference in the width direction caused by the high speed blowing of the gas and preventing the strip from fluttering by making the best use of the holding rolls.

To achieve the above object, the present invention is a rapid cooling apparatus in a continuous annealing facility for cooling a travelling steel strip by blowing gas through a plurality of nozzles protruding from a surface of a cooling chamber installed in the continuous annealing facility so as to keep the tips of the nozzles 50 to 100 mm distant from the surface of the steel strip, characterized by disposing the cooling chamber so that the maximum width of the steel strip and the distance from the surface of the cooling box to the steel strip satisfy the expression (1) below:

$$6 < W\max/H < 13 \quad (1),$$

where W is the maximum width of the steel strip (mm), and H is the max distance (mm) from the surface of the cooling chamber to the steel strip.

Further, the present invention is also a rapid cooling apparatus in a continuous annealing facility for cooling a travelling steel strip by blowing gas through a plurality of nozzles protruding from a surface of a cooling chamber installed in the continuous annealing facility so as to keep the tips of the nozzles 50 to 100 mm distant from the surface of the steel strip, characterized by disposing the cooling chamber so that an Re number satisfies the expression below:

$$\text{Re number} \leqq 500{,}000,$$

when an Re number at an edge of the steel strip is defined as Re number=L×V/υ, where L=½×strip width, V=the average flow rate of gas in the direction of the width of the strip at an edge=Q/H, Q=½×the amount of gas blown to the strip, and υ=coefficient of kinematic viscosity.

A schematic illustration of the rapid cooling zone of a continuous annealing furnace.

[FIG. 2]

Figure 1:
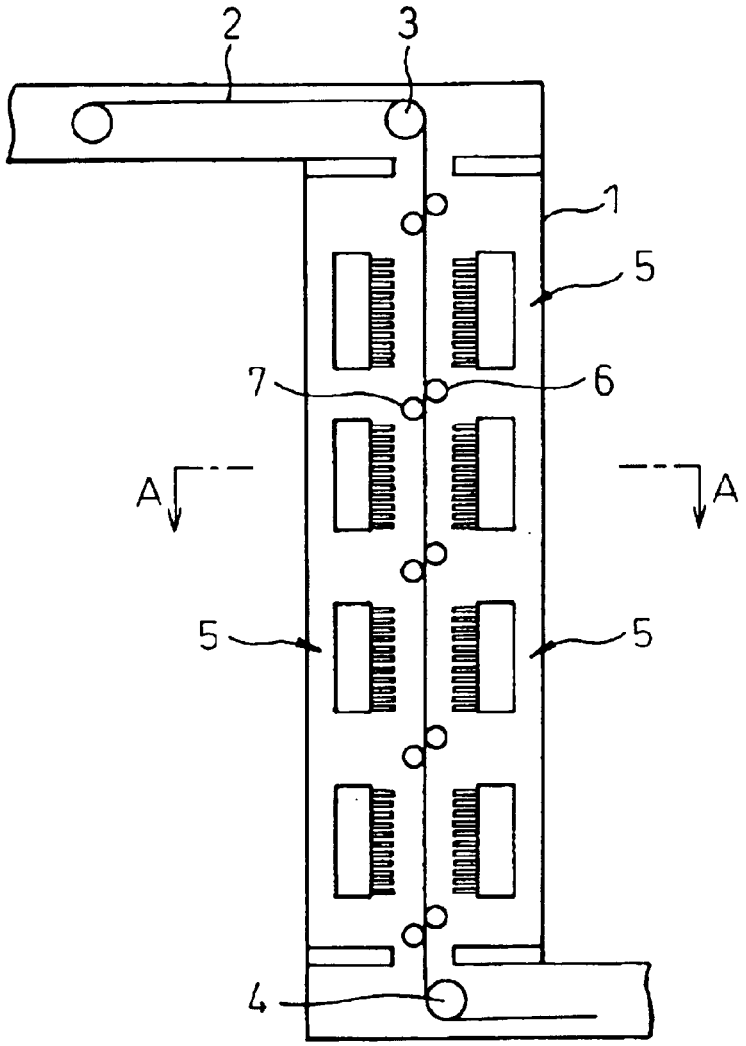
[FIG. 1]

A section view taken on line A—A of FIG. 1.

[FIG. 3]

A schematic illustration of cooling apparatuses installed in the rapid cooling zone.

[FIG. 4]

Figure 3:
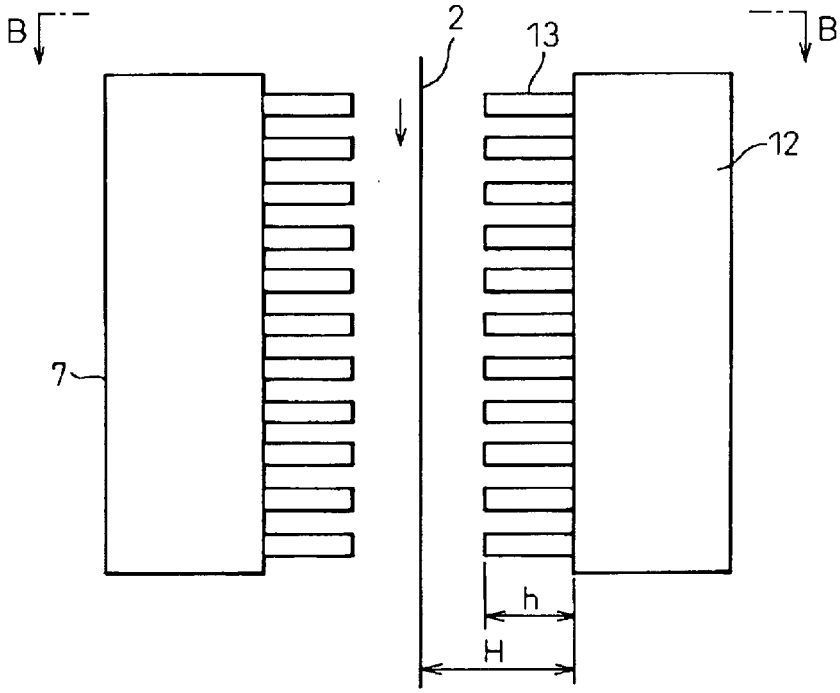

A section view taken on line B—B of FIG. 3.

[FIG. 5]

Illustrations based on an experiment, showing the flow of the gas blown through the protruding nozzles in the direction of the strip width when H is 175 mm.

[FIG. 6]

Illustrations based on an experiment, showing the flow of the gas blown through the protruding nozzles in the direction of the strip width when H is 275 mm.

[FIG. 7]

A graph showing the relationship between the maximum width of the steel strip and the gas blowing distance.

[FIG. 8]

A graph showing the relationship between the distance from the protruding nozzle tips to the steel strip and the heat transfer coefficient.

[FIG. 9]

A schematic illustration for clarifying the range in which the strip flutter is suppressed.

[FIG. 10]

A graph showing verifying data regarding a relationship between Re number and the strip flutter.

EXPLANATION OF REFERENCE NUMERALS AND SYMBOLS

1: Furnace body

2: Steel strip

3: Upper roll

4: Lower roll

5: Cooling apparatus

6: Holding roll

7: Holding roll

8: Gas suction port

9: Heat exchanger

10: Circulation blower

11: Circulation duct

12: Cooling chamber

13: Protruding nozzle h: Height of protruding nozzles (mm)

H: Distance from cooling chamber surface to steel strip surface (mm)

W: Steel strip width (mm)

Wmax: Maximum Width of steel strip (mm)

Z: Distance from protruding nozzle tips to steel strip surface (mm)

L: Half of steel strip width (mm)

THE MOST PREFERRED EMBODIMENT

The present invention is explained in detail hereafter based on examples shown in the attached drawings.

Figure 2:
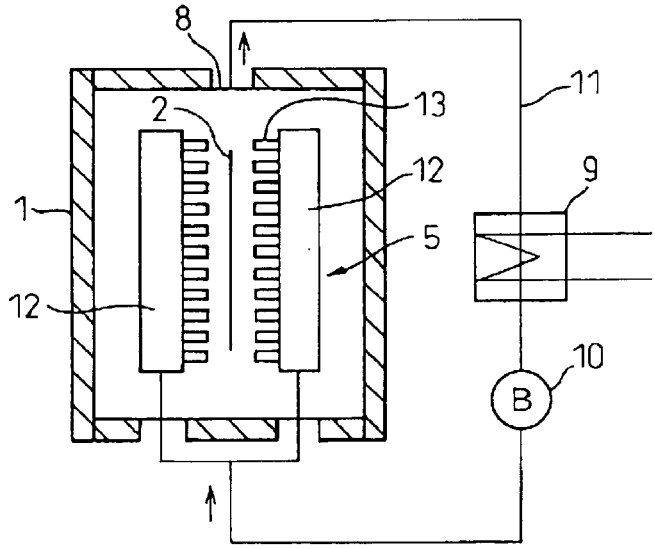
Figure 4:
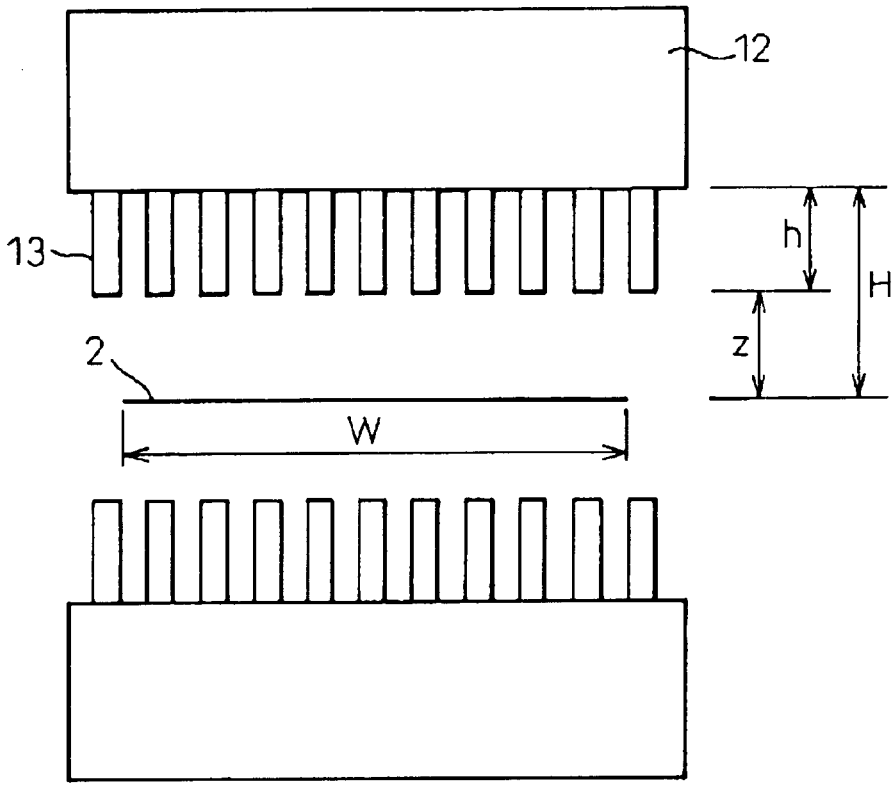
Figure 5:
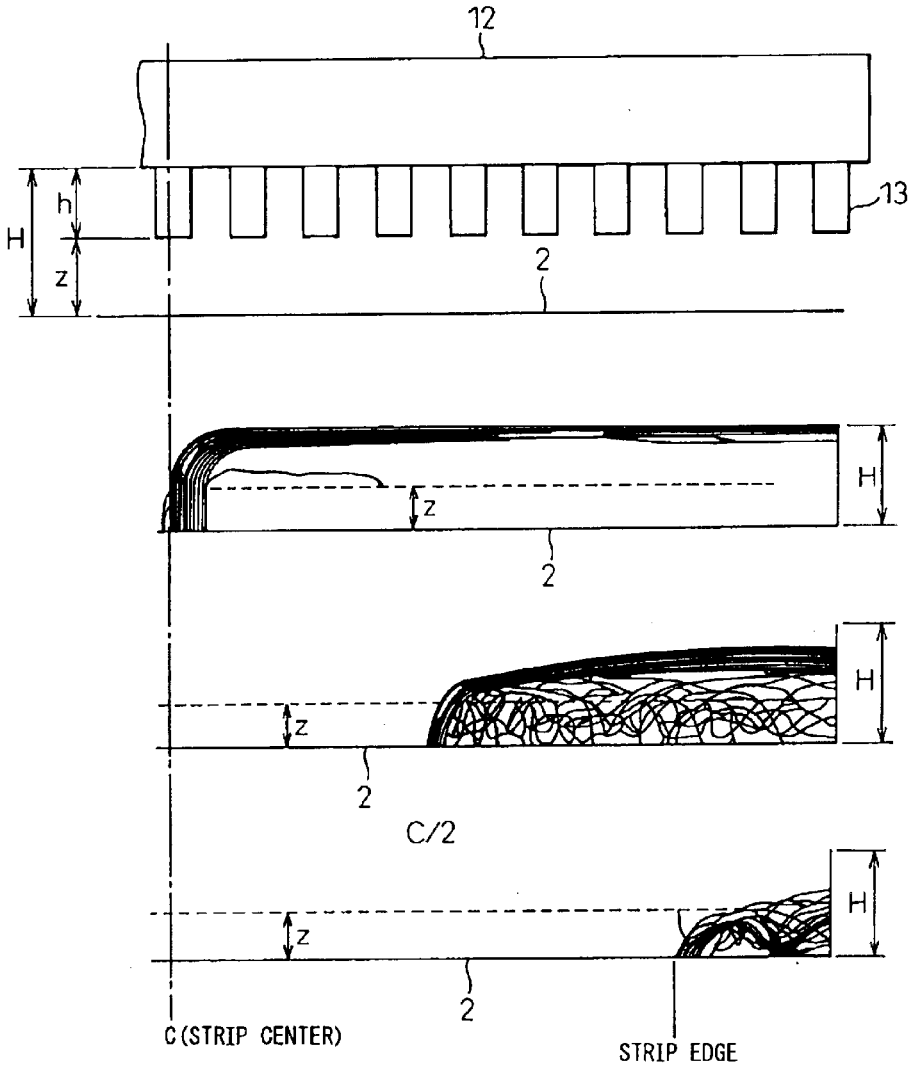
Figure 6:
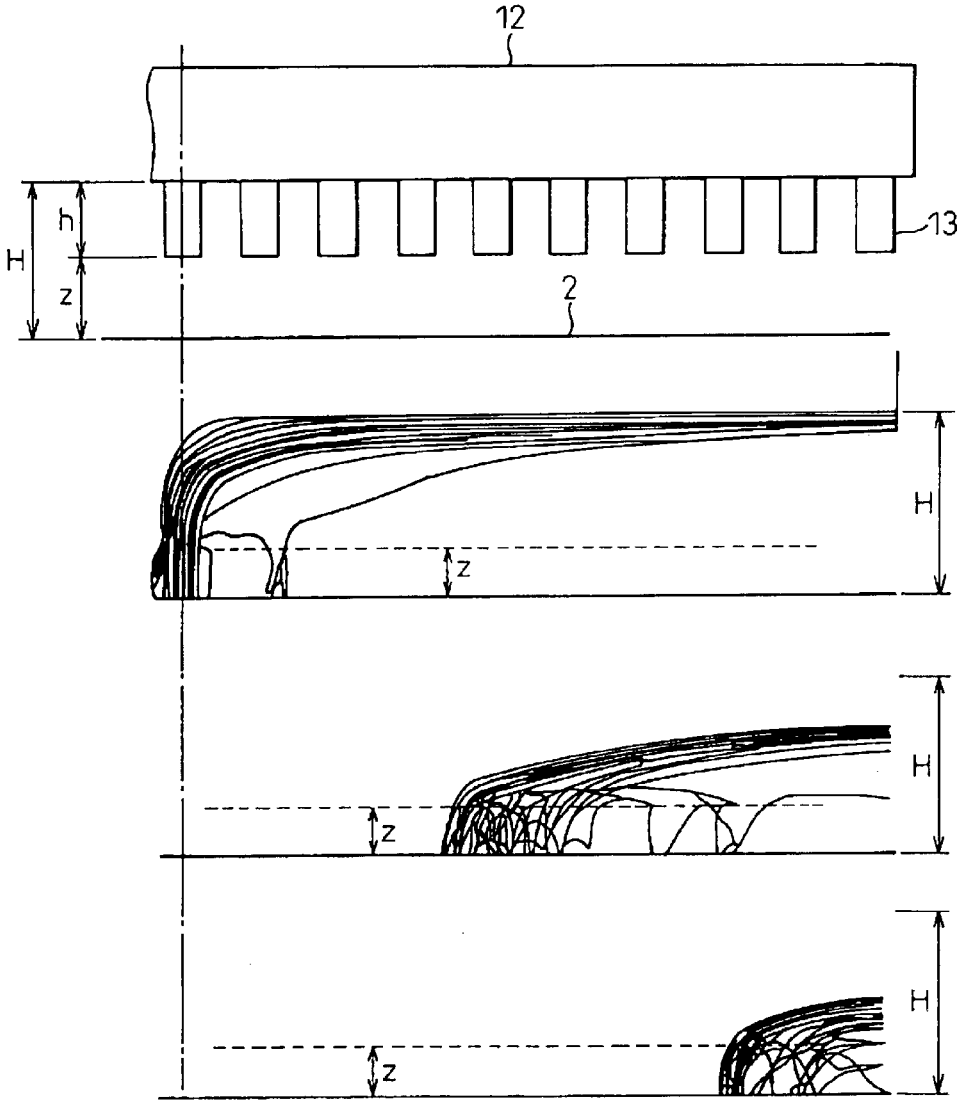
Figure 7:
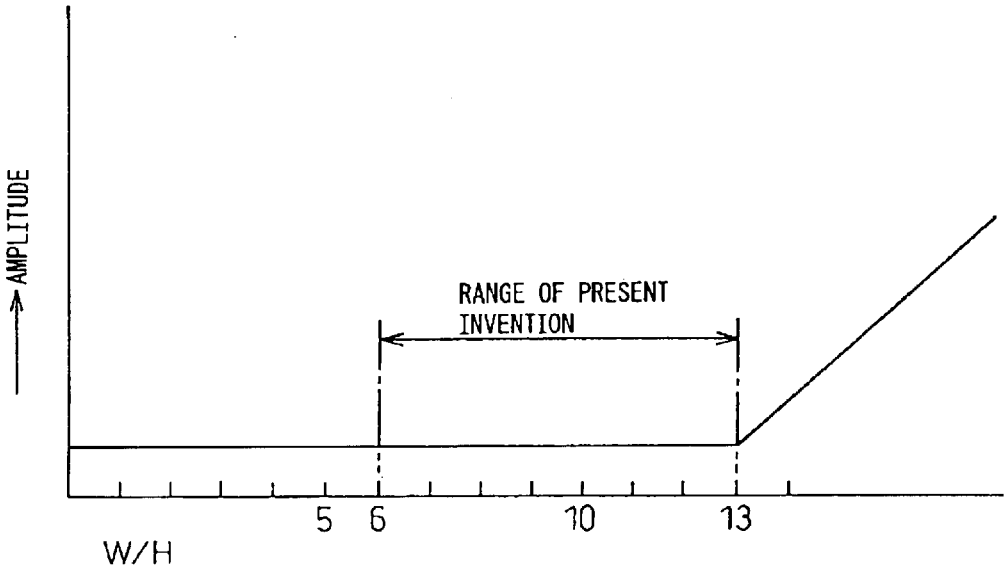
Figure 8:
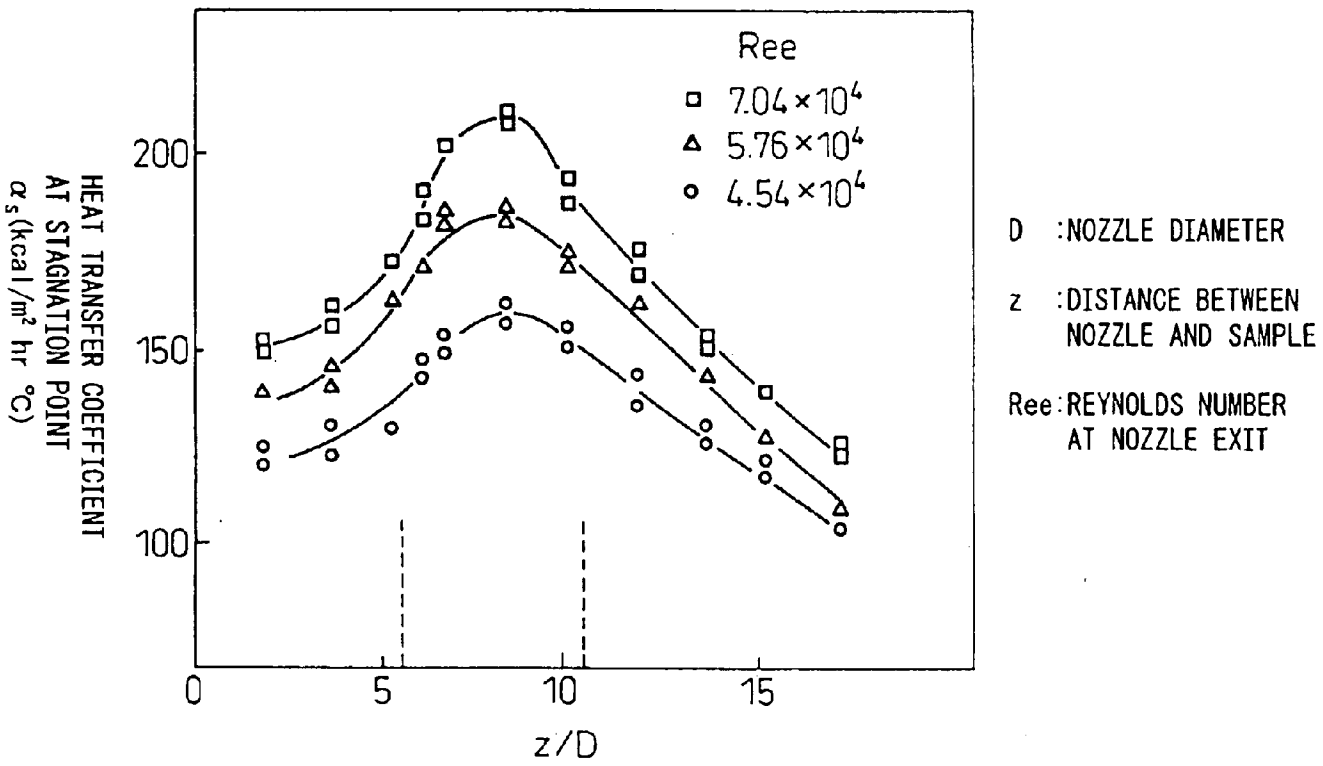

FIG. 1 is a schematic illustration of a rapid cooling zone of a continuous annealing furnace, and FIG. 2 a section view taken on line A—A of FIG. 1. FIG. 3 is a schematic illustration of cooling apparatuses installed in the rapid cooling zone, and FIG. 4 is a section view taken on line B—B of FIG. 3. FIGS. 5 and 6 are illustrations based on an experiment, showing the flow of the gas blown through the protruding nozzles in the direction of the strip width. FIG. 7 is a graph showing the relationship between the maximum width of the steel strip and the distance of gas blowing. FIG. 8 is a graph showing the relationship between the distance from the tips of the protruding nozzles to the steel strip and the heat transfer coefficient.

A continuous annealing furnace consists, generally, of a heating zone, a soaking zone, a primary cooling zone equipped with rapid cooling apparatuses, an overaging zone and a subsequent secondary cooling zone, all enclosed in furnace shells, and a steel strip is processed while travelling through these zones continuously.

The units of the rapid cooling apparatuses according to the present invention in the cooling zone are installed between the upper and lower rolls 3 and 4 disposed in a furnace body 1 for transporting the steel strip 2, as outlined in FIG. 1. The cooling apparatuses 5 to blow gas are disposed in plural pairs along the passage of the steel strip 2 between the upper and lower rolls so that each of the pair of the cooling apparatuses faces each of the surfaces of the steel strip 2. Between the pairs of the cooling apparatuses 5 adjacent to each other in the vertical direction, the pairs of holding rolls 6 and 7 for preventing the steel strip 2 from fluttering are disposed so as to hold the steel strip 2 in between.

FIG. 2 is a section view taken on line A—A of FIG. 1. The gas blown from the cooling apparatuses 5 to the steel strip 2 is sucked through the gas suction port 8 disposed in the furnace body 1, returned to the cooling apparatuses 5 after passing through the heat exchanger 9 and the circulation blower 10, and blown to the steel strip 2 again. The heat exchanger 9 and the circulation blower 10 are connected through the circulation ducts 11 and the gas blown to the steel strip 2 in the furnace is circulated and reused.

A cooling apparatus 5 is composed of a pair of the cooling chambers 12 and the protruding nozzles 13, each having a round blowing hole, installed on the surface of each of the cooling chambers 12 facing the steel strip. The protruding nozzles disclosed in said Japanese Examined Patent Publication No. H2-16375 are used as the protruding nozzles 13, and the area of the nozzle openings accounts for 2 to 4% of the area of the surface of each cooling chamber 12. The use of the protruding nozzles 13 allows the nozzle tips to be disposed close to the steel strip 2, and thus the cooling capacity of the apparatus can be enhanced remarkably. The cooling capacity is optimized by designing the area of the nozzle openings so as to account for 2 to 4% of the cooling chamber surface.

FIG. 3 and FIG. 4, which is a section view taken in line B—B of FIG. 3, show an outline of experimental cooling apparatuses used for working out the present invention, in which the protruding nozzles 13, each having a round blowing hole, are installed on the surface of each of the cooling chambers 12 facing the steel strip. The protruding nozzles 13 are disposed so that the area of the nozzle openings accounts for 2 to 4% of the surface area of each cooling chamber 12; the figure is actually 2.8% in the experimental cooling apparatuses. The experiments were carried out under the following conditions: the height h of the protruding nozzles 13 was set at 100 mm when the distance H from the surface of each cooling chamber 12 to the steel strip 2 was 175 mm; the height h was set at 200 mm when the distance H was 275 mm. The gas flow speed at the nozzle tip was set at 120 m/sec. Note that W in the figure indicates the width of the steel strip 2. The result of the experiment under H=175 mm is shown in FIG. 5, and that under H=275 mm in FIG. 6. The illustrations of gas flow in FIGS. 5 and 6 show the gas flows on the right side half of a steel strip.

As seen in FIG. 5-*a*, the gas blown to the center portion of the steel strip 2 hits the steel strip 2, bounces back and flows (as shown in black solid lines) towards the edge of the steel strip 2 forming a layer along the surface of the cooling chamber 12.

Next, FIG. 5-*b* shows the flow of the gas blown to the middle of the right side half of the steel strip 2. In the figure, the gas blown to the middle of the right side half of the steel strip, though the gas hits the steel strip 2 then bounces back and moves towards the cooling chamber, is hindered from bouncing after hitting the strip by the layer of the gas blown to the center portion of the strip as described above, and most of the gas flows towards the strip edge while stagnating in the zone (z) between the tips of the protruding nozzles and the steel strip. Then, FIG. 5-*c* shows the behavior of the gas blown to the portion near the edge of the steel strip 2, wherein it is seen that the gas blown to near the edge flows out of the edge portion while stagnating in the zone (z) between the protruding nozzles and the steel strip.

As explained above, if only the height h of the protruding nozzles 13 and the blowing distance z from the nozzle tips to the steel strip are specified as in the conventional case, the gas blown through the nozzles is hindered from flowing towards the strip edge by the gas blown to the center portion of the steel strip, and flows out while the blown gas stagnates near the strip edge as seen in FIG. 5. Therefore, it has been made clear that, even if the positions of the cooling chambers 12 are decided based on the height h of the protruding nozzles and the distance z from the tips of the protruding nozzles to the steel strip as in the conventional case, neither the temperature difference of the steel strip in the width direction is eliminated, nor is the strip is prevented from fluttering.

To solve the problem, an experiment was carried out setting the distance H from the surface of the cooling chamber 12 to the steel strip 2 at 275 mm and the distance z from the steel strip 2 to the tips of the protruding nozzles 13 at 75 mm. The result is shown in FIG. 6.

As seen in FIG. 6-*a*, the gas blown to the center portion of the steel strip 2 hits the steel strip, then bounces back towards the cooling chamber and flows out from the edge of the steel strip by forming a layer along the surface of the cooling chamber.

Next, as for the gas blown to the middle of the right side half of the steel strip, as seen in FIG. 6-*b*, most of the gas forms a layer below the layer of the gas blown to the center portion of the steel strip and flows out from the strip edge.

Then, as seen in FIG. 6-*c*, the gas blown to the edge portion of the steel strip hits the strip, and then flows out from the strip edge through the part below the gas layer shown in FIG. 6-*b*.

As explained above, the flow out state of the cooling gas after hitting the steel strip 2 changes depending on the distance from the surface of the cooling chamber 12 to the steel strip 2.

It has been made clear from the above results that, when the gas blown to the steel strip is stagnated at the strip edge, the edge portion of the steel strip is overcooled and there occurs a temperature difference in the strip width direction. The stagnation of the gas is considered to cause the rise of inner pressure at the edge portion, leading to a flutter (oscillation) of the steel strip. Since the rapid cooling zone of a continuous annealing facility is designed based on the maximum width of the steel strip, the capacity of the cooling apparatuses in the zone is designed on the basis of the maximum strip width. For this reason, the temperature difference in the strip width direction caused by the gas blown to the steel strip and the oscillation of the steel strip caused by the stagnation of the gas are prevented from occurring by properly setting the distance from the surface of each cooling chamber to the steel strip in the maximum width of the steel strip to be processed (cooled).

FIG. 7 shows the occurrence of the flutter (oscillation) of the steel strip in relation to the relationship between the maximum width of the steel strip (Wmax) and the distance (H) from the steel strip to the surface of the cooling chamber. The flutter of the steel strip becomes conspicuous when the ratio of the maximum width of the steel strip (Wmax) to the distance (H) from the surface of the cooling chamber to the steel strip exceeds 13. When the ratio is 6 or less, flutter does not occur, but the cooling capacity is decreased because the blowing distance becomes large.

A suitable range of the value of Wmax/H is from 6 to 13, preferably from 6 to 12 and, more preferably, from 6 to 11.

The cooling capacity of a steel strip is determined by the diameter (D) of the nozzles and the distance (z) from the nozzle tips to the steel strip. The nozzle diameter is usually 9.2 mm. The coefficients of heat transfer α (at the collision/stagnation zone of a fluid blown to a steel strip perpendicularly) of different cooling fluids change as shown in FIG. 8 as the distance z from the nozzle tips to the steel strip changes (see the Proceedings of the $5^{th}$ Japanese Heat Transfer Symposium, May 1968, p. 106). A high value of α is obtained with any fluid when the value of z/D is 5.4 to 10.8. This indicates that, in the case of a commonly used nozzle diameter (9.2 mm), it is desirable for obtaining good cooling capacity to set the distance z from the nozzle tips to the steel strip at 50 mm at the smallest and 100 mm at the largest, approximately.

Table 1 shows the relationship between the maximum width of a steel strip (Wmax) processed in a continuous annealing facility and the distance (H) from a cooling chamber to the steel strip. When the maximum width of the strip (Wmax) to be processed is given, the distance (H) from the cooling chamber to the steel strip is determined from the table.

TABLE 1

| Strip width (W) | Height (H) | Height (H) | Height (H) | (W/H) | (W/H) | (W/H) |
|---|---|---|---|---|---|---|
| 800 | 150 | — | — | 5.3 | | |
| 900 | 150 | — | — | 6.0 | | |
| 1100 | 150 | — | — | 7.4 | | |
| 1200 | 150 | 200 | — | 8.0 | 6.0 | — |
| 1300 | 130 | 200 | — | 8.0 | 6.5 | — |
| 1400 | 150 | 200 | — | 8.7 | 7.0 | — |
| 1500 | 150 | 200 | — | 10.0 | 7.5 | — |
| 1600 | 150 | 200 | — | 10.8 | 8.0 | — |
| 1700 | 150 | 200 | — | 11.3 | 8.5 | — |
| 1800 | 150 | 200 | 300 | 12.0 | 9.0 | 6.0 |
| 1900 | 150 | 200 | 300 | 12.6 | 9.5 | 6.3 |
| 2000 | 150 | 200 | 300 | 13.3 | 10.0 | 6.7 |

The reason of said effect can also be explained from a different viewpoint.

The upper limit of the range of the value of Wmax/H in which the flutter of the steel strip is suppressed is determined on the basis of the experimental result.

The occurrence of flutter can be kept under control by suppressing the flow of the gas flowing along the strip surface after hitting the strip.

Figure 9:
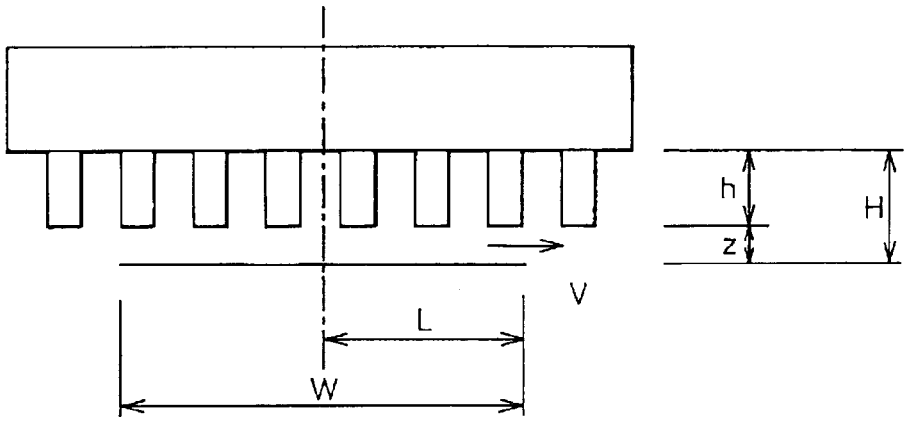
Figure 10:
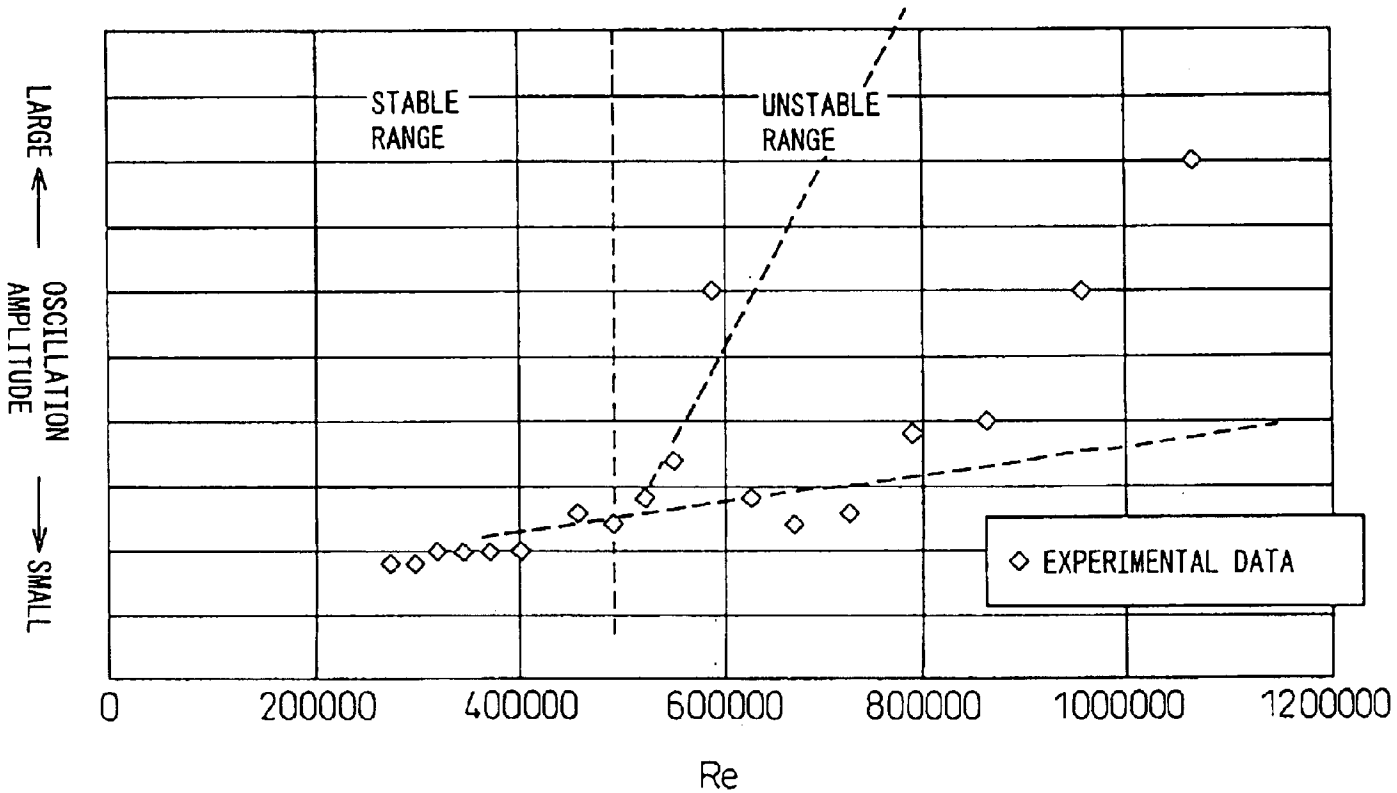

The result shown in FIG. 10 is obtained through the examination of the relationship between the change of Re number and the occurrence of the strip flutter. Note here that the Re number at an edge of a steel strip in FIG. 9 is given as L×V/υ, where L=½×strip width, V=the average flow rate of gas in the direction of the width of the strip at an edge=Q/H, Q=½×the amount of gas blown to the strip, and υ=coefficient of kinematic viscosity.

In FIG. 10, the stable region means the region where the strip flutter is small, and the unstable region means the region where the strip flutter is large.

From the above, the flutter of the steel strip can be suppressed by controlling the Re number to 500,000 or less.

When the Re number is 500,000, the following expression holds true:

$$Wmax/H=2L/H=2\times Re\times \upsilon/Q\leqq 13.$$

TABLE 2

| Kind of gas | Wmax | H | Wmax/H | Re | Oscillation | Cooling capacity |
|---|---|---|---|---|---|---|
| | Occurrence or otherwise of oscillation | | | | | |
| $H_2$ 5% + $N_2$ 95% | 1200 | 100 | 12 | 410370 | ○ | ○ |
| | | 150 | 8 | 273580 | ○ | ○ |
| | | 200 | 6 | 205185 | ○ | ○ |
| | | 250 | 4.8 | 164148 | ○ | ○ |
| | | 300 | 4 | 136790 | ○ | ○ |
| | [mm] | 350 | 3.4 | 117249 | ○ | x |
| | 1600 | 100 | 16.0 | 729547 | x | ○ |
| | | 150 | 10.7 | 486365 | ○ | ○ |
| | | 200 | 8.0 | 364774 | ○ | ○ |
| | | 250 | 6.4 | 291819 | ○ | ○ |
| | | 300 | 5.3 | 243182 | ○ | ○ |
| | [mm] | 350 | 4.6 | 208442 | ○ | x |
| | 2000 | 100 | 20.0 | 1139918 | x | ○ |
| | | 150 | 13.3 | 759945 | x | ○ |
| | | 200 | 10.0 | 569959 | x | ○ |
| | | 250 | 8.0 | 455967 | ○ | ○ |
| | | 300 | 6.7 | 379973 | ○ | ○ |
| | [mm] | 350 | 5.7 | 325691 | ○ | x |
| $H_2$ 50% + $N_2$ 50% | 1200 | 100 | 12 | 358992 | ○ | ○ |
| | | 150 | 8 | 239328 | ○ | ○ |
| | | 200 | 6 | 179496 | ○ | ○ |
| | | 250 | 4.8 | 143597 | ○ | ○ |
| | | 300 | 4 | 119664 | ○ | ○ |
| | [mm] | 350 | 3.4 | 102561 | ○ | x |
| | 1600 | 100 | 16.0 | 649465 | x | ○ |
| | | 150 | 10.7 | 432977 | ○ | ○ |
| | | 200 | 8.0 | 324733 | ○ | ○ |
| | | 250 | 6.4 | 259786 | ○ | ○ |
| | | 300 | 5.3 | 216488 | ○ | ○ |
| | [mm] | 350 | 4.6 | 185562 | ○ | x |
| | 2000 | 100 | 20.0 | 1014790 | x | ○ |
| | | 150 | 13.3 | 676526 | x | ○ |
| | | 200 | 10.0 | 507395 | x | ○ |
| | | 250 | 8.0 | 405916 | ○ | ○ |
| | | 300 | 6.7 | 338263 | ○ | ○ |
| | [mm] | 350 | 5.7 | 289940 | ○ | x |

Oscillation: ○ did not occurred, x occurred
Cooling capacity: ○ good, x poor

EXAMPLE

Table 2 shows the examples.

It is clear from the table that, in any of the kinds of the gasses and the maximum strip widths, oscillation of the strip does not occur when Wmax/H<13 is true (it occurs always when Wmax/H is larger than 13). It follows that, therefore, as far as the condition of Wmax/H<13 is maintained, oscillation does not occur. When the length h of the nozzles becomes larger, on the other hand, the resistance of the fluid in the nozzles increases and, as a consequence, a fan having a large capacity for boosting pressure is required for blowing the cooling gas to the cooling chambers 12.

Therefore, the shorter the nozzles are, the more economical the whole equipment becomes.

From the viewpoint of the limit of the fan capacity in boosting the pressure, on the other hand, it is considered that the practical limit of the nozzle length is 200 mm or so.

Further, an optimum value of the blowing distance z is 50 to 100 mm; when it is larger than 100 mm, the cooling capacity is decreased.

From the above, the cooling capacity is decreased when the distance from the cooling chamber 12 to the steel strip 2 is 300 mm or more.

From Table 2, in any of the kinds of the gasses and the maximum strip widths, the range of Wmax/H not lowering the cooling capacity is defined by the expression Wmax/H>6.

INDUSTRIAL AVAILABILITY

As has been explained, the temperature difference in the strip width direction caused by rapid cooling is suppressed and the load on the holding rolls to suppress the flutter of the steel strip is decreased by applying the present invention, because, according to the present invention, the installation position of the cooling chambers in the rapid cooling zone of a continuous annealing facility is determined based on the maximum width of the steel strip to be processed. By the present invention, as the distance from the surface of the cooling chamber to the steel strip, which constitutes one of the problems in the rapid cooling zone, can be determined in relation to the maximum width of the steel strip to be processed, rather than in relation to the protruding nozzles, as described above, the design of the equipment is simplified.

Explanation of Reference Numerals and Symbols

1: Furnace body
2: Steel strip
3: Upper roll
4: Lower roll
5: Cooling apparatus
6: Holding roll
7: Holding roll
8: Gas suction port
9: Heat exchanger
10: Circulation blower
11: Circulation duct
12: Cooling chamber
13: Protruding nozzle
h: Height of protruding nozzles (mm)
H: Distance from cooling chamber surface to steel strip surface (mm)
W: Steel strip width (mm)
Wmax: Maximum Width of steel strip (mm)
Z: Distance from protruding nozzle tips to steel strip surface (mm)
L: Half of steel strip width (mm)

What is claimed is:

1. A method for rapidly cooling a steel strip traveling through a continuous annealing facility comprising:

providing a cooling chamber in the continuous annealing facility, with the cooling chamber having a surface facing the traveling steel strip;

providing a plurality of nozzles protruding from said surface of the cooling chamber;

maintaining tips of said plurality of nozzles at a 50 to 100mm distance from said surface of the traveling steel strip;

disposing the cooling chamber in the continuous annealing facility for providing an Re number at an edge of the traveling steel strip satisfying the expression:

$$\text{Re number} \leqq 500{,}000,$$

wherein Re number at the edge of the steel strip is defined as Re number=L×V/υ, wherein:

L=½×steel strip width,

V=average flow rate of gas in the direction of the width of the steel strip at an edge=Q/H, Q=½×amount of gas blown on the steel strip, υ=coefficient of kinematic viscosity, and H=distance (mm) from said surface of the cooling chamber to said surface of the traveling steel strip.

* * * * *